US005162005A

United States Patent [19]

Poldervaart

[11] Patent Number: 5,162,005

[45] Date of Patent: Nov. 10, 1992

[54] MOORING DEVICE

[75] Inventor: Leendert Poldervaart, La Turbie, France

[73] Assignee: Single Buoy Moorings, Inc., Marly, Switzerland

[21] Appl. No.: 642,217

[22] Filed: Jan. 16, 1991

[51] Int. Cl.[5] ..... B63B 22/02

[52] U.S. Cl. ..... 441/3; 114/230

[58] Field of Search ..... 441/3, 4, 5; 114/230, 114/293

[56] References Cited

U.S. PATENT DOCUMENTS

| | | | |
|---|---|---|---|
| 3,442,245 | 5/1969 | Christians et al. | 441/5 |
| 4,798,155 | 1/1989 | Poldervaart | 441/3 |
| 5,041,038 | 8/1991 | Poldervaart et al. | 114/230 |

FOREIGN PATENT DOCUMENTS

| | | | |
|---|---|---|---|
| 2575129 | 6/1986 | France | 114/293 |
| 18588 | 1/1986 | Japan | 441/3 |
| 2040849 | 9/1980 | United Kingdom | 114/230 |
| 2166398 | 5/1986 | United Kingdom | 114/293 |

*Primary Examiner*—Jesus D. Sotelo
*Assistant Examiner*—Thomas J. Brahan
*Attorney, Agent, or Firm*—Young & Thompson

[57] ABSTRACT

Mooring device comprising a vessel and a body carrying anchor lines which body is rotatable about a substantially vertical axis or weathervaning axis with respect to the vessel and attached to the vessel in a manner such that in case a predetermined load in one or more of the anchor lines is exceeded the body swings away with respect to the vessel in the direction of the load to avoid overloading of anchor lines and mooring device by changing the load excursion characteristic in such a way that at the predetermined load, excursion can take place without substantial change of the load.

6 Claims, 4 Drawing Sheets

MOORING DEVICE

BACKGROUND OF THE INVENTION

The present invention relates to a mooring device comprising a vessel, a body carrying anchor lines which extend in different directions according to catenary lines towards bottom anchors, said body being rotatably supported about a substantially vertical axis by a part which is movably connected with the vessel and held in an initial position with respect to the vessel by means which can give way to allow movement of the vessel away from the said body in case the tension in at least one of the anchor lines exceeds a predetermined value.

A mooring device of this type has been disclosed by the published Dutch patent application 8402398. According to said prior art the rotatable body carrying the anchor lines is rotatabiy supported at the lower end of a turret which at the top of the bow of the vessel is swingably mounted about a horizontal axis to rigid arms which extend forwardly from the bow of the vessel.

The lower end of said turret is held in abutment against e.g. a bulb extension of the bow of the vessel by means of a weight which keeps the turret against said abutment with a certain predetermined load.

The design is such that under normal weather conditions the vessel may swing around the vertical axis of the turret and can swing around said vertical axis and be displaced by wind, waves and/or currents.

The catenary lines function like a spring the rigidity of which increases rapidly with excursion of the vessel away from its initial position in which it is held by the catenary lines. Under normal weather conditions the load excursion relation remains sufficiently elastic, but under heavy weather conditions, such as heavy storms, the load on the anchor lines, at least on one of said lines, increases to a value which may damage the line or damage parts of the mooring device.

This is particularly the case if stormy weather conditions occur which statistically occur only once in a century. If this occurs said prior art mooring device allows further excursion of the vessel without substantial increase of the load on one or more of the anchor lines because then the load is overcome which keeps the turret against its position allowing the turret to swing about the horizontal transverse axis at the top of the turret. Further excursion of the vessel then is possible without increasing the load until after a certain displacement the anchor lines again become further tensioned.

Swinging about a horizontal transverse axis however means that the initially vertical axis of rotation of the body moves into an inclined position. This has as a consequence that the rotatable body moves into an inclined position as well with its plane of points of connection of the anchor lines. This may lead to rotational swinging movements of said body because if one anchor line is tightened the line extending in the opposite direction is slackened, accordingly has a considerably lower tension so that the tensioned anchor line on the other side might try to move downwardly, thereby rotating the body and lifting the slackened tension line. All this is promoted by the fact that the inclined position of the turret occurs under extremely heavy weather conditions during which the vessel is also rolling about its longitudinal axis and pitching about its transverse axis. Said last mentioned movements lead to swinging of the turret which increases the load on the anchor lines in an uncontrollable way and interferes with the rolling movements about the longitudinal axis of the vessel. The result is heavy loads in the bearings of the horizontal transverse axis at the top of the turret and heavy loads in the entire construction in particular the arms carrying the weight.

Through the turret extends a product line which at least below the rotatable body carrying the anchor lines is a hose. The inclined position of the turret under extremely heavy weather conditions and the swinging of said turret, as described above, may damage the hose with the effect that the environment will become polluted.

SUMMARY OF THE INVENTION

Purpose of the invention is to provide a mooring device which does not have the above described disadvantages of the prior art device.

According to the invention this is achieved in that the said movement of the body with respect to the vessel is guided by means which keep the vertical axis of rotation of the body parallel to itself. In other words, although said body upon the occurrence of extremely heavy conditions moves away from the vessel allowing excursion of the vessel without increasing the load on one or more of the anchor lines the vertical axis itself does not change its position with respect to longitudinal, vertical and horizontal transverse axes of the hull of the vessel. This keeps the anchor lines in a relatively normal position and also keeps the hose which from the turret extends downwardly in its normal vertical position without, as in the known device, being bent at the location of its entrance into the turret and there subjected to bending movements.

Said displacement can be performed in many ways as there are many systems feasible for keeping the body in its initial position such as by means of hydraulic jacks, weight-loaded cables etc.

One possibility of movement of the body is obtained in that the body is mounted at the end of an arm which extends laterally at an angle with respect to the longitudinal axis of the vessel, e.g. an angle of 90°, so that in fact the rotatable body, which may be at the lower end of a turret, is present at the outer end of a transversely extending arm which can swing about a vertical axis in a forward direction. In that case the arm extends laterally outside the hull of the vessel. Preferably the arm extends laterally from the bow portion of the vessel with a length allowing swinging towards a position in front of the bow of the vessel.

The entire mooring system may also be present inside a hollow space of the hull which space is open at the bottom as disclosed in principle by UK patent application 2,139,978.

The rotatable body or turret can be supported according to the invention by a larger element which itself is rotatably supported about a substantially vertical axis by the hull with said vertical axis at a distance from the vertical axis of the body. This means that the rotatable body carrying the anchor lines or turret is located excentrically with respect to the axis of rotation of said larger element.

Such a larger element can be a cylinder or sleeve with vertical axis of rotation in the bow portion of the vessel with proper bearing structures at top and bottom for taking up all loads and moreover has the advantage that the means which hold said element in place with a certain preload can act upon its circumference.

Thus said sleeve may be provided with a toothed ring engaged by a gear connected to a hydraulic motor which is part of a hydraulic circuit which prevents rotation of motor and gear until a pressure relief valve is opened in case the predetermined load is reached. By means of said braking system driving of the sleeve may be performed as well to move the rotatable body which carries the anchor chains or turret into a desirable position by rotation in one or the other direction. The hydraulic circuit with pressure relief valve can be of the type of U.S. application Ser. No. 642,216, filed Jan. 16, 1991.

DETAILED DESCRIPTION OF THE FIGURES

Figure 1:
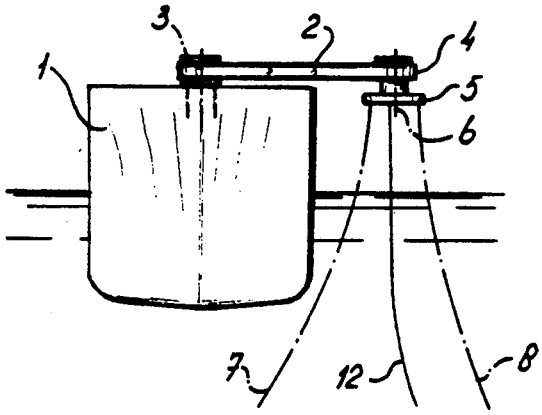
FIG. 1 is a diagrammatic front view of the mooring device of the invention.

FIG. 1 shows a vessel 1 which at the top deck of the bow portion has been provided with a laterally extending arm 2 which can swing about a vertical axis 3 in a horizontal plane. Said arm 2 carries at its outer end 4 a turntable 5 which is rotatable about a vertical axis 6 and from which extend downwardly anchor lines 7 and 8.

Said arm 2 is held against an abutment 9 by means of a cable 10 loaded by a weight 11.

Instead of said weight-loaded cable other means are feasible such as a hydraulic piston-cylinder unit.

Under normal weather conditions the arm 2 is held against the abutment 9 and the vessel is held in place by the anchor lines 7, 8 etc.

Figure 2:
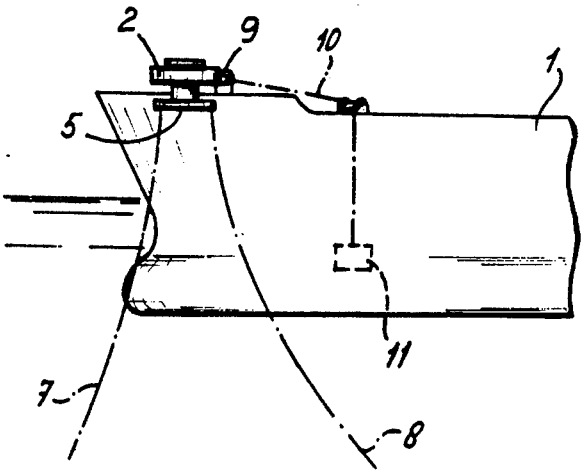
FIG. 2 is a side view.
Figure 3:
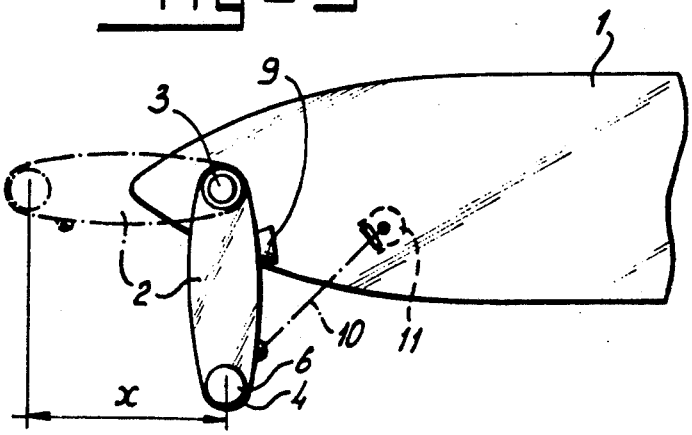
FIG. 3 is a top view of the device of FIGS. 1 and 2.

If the predetermined load is reached and passed the already displaced vessel, which in FIG. 2 has been displaced to the right, now is further displaced with simultaneous forward swinging of the arm 2 as shown in FIG. 3 with interrupted lines. This means that the turntable 5 moves to a position in front of the bow of the vessel. This allows an excursion x, as shown in FIG. 3, which excursion corresponds to the substantially horizontal part of the curve O A B, shown in FIG. 10.

The above described diagrammatic drawings make clear that the turntable remains in a position in which it will not bend the hose 12.

The embodiment disclosed in FIGS. 1 to 3 incl. is not the most advantageous if attention is paid to the loads which occur on the arm and on the bearings of said arm at the axis 3 and at the turntable.

Figure 4:
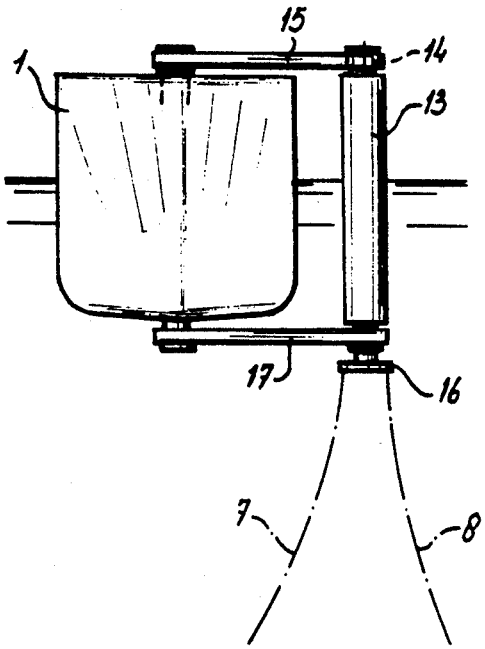
FIGS. 4 and 5 are front and side views respectively of an alternative embodiment.
Figure 5:
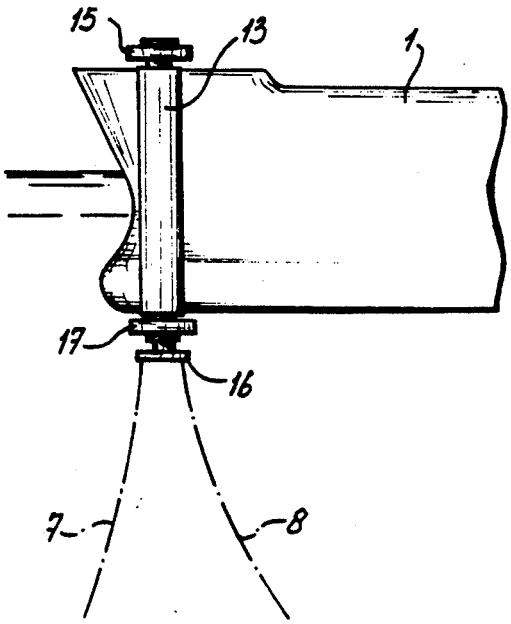

FIGS. 4 and 5 disclose an embodiment which in this respect is already somewhat better. According to said embodiment the rotatable body is a turret 13 which at its top is rotatably supported at 14 in an arm 15 and at its lower end above the anchor table 16, from which the anchor lines 7 and 8 extend rotatably supported by means of a lower arm 17.

Figure 6:
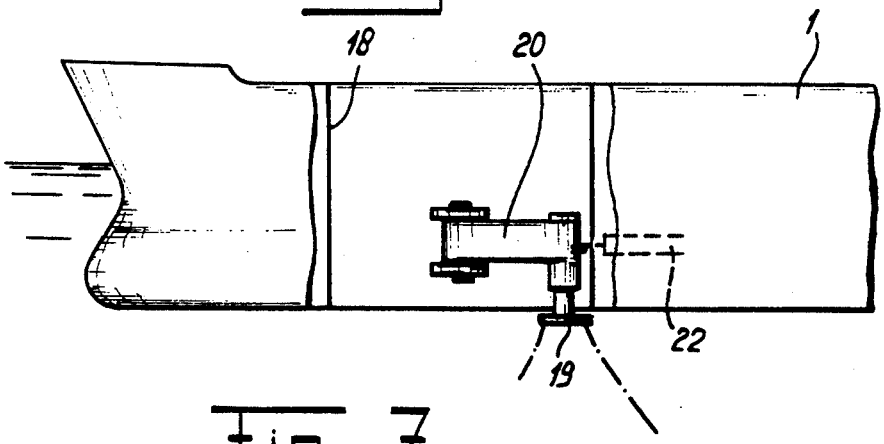
FIGS. 6 and 7 respectively are side views and top view of a further alternative.
Figure 7:
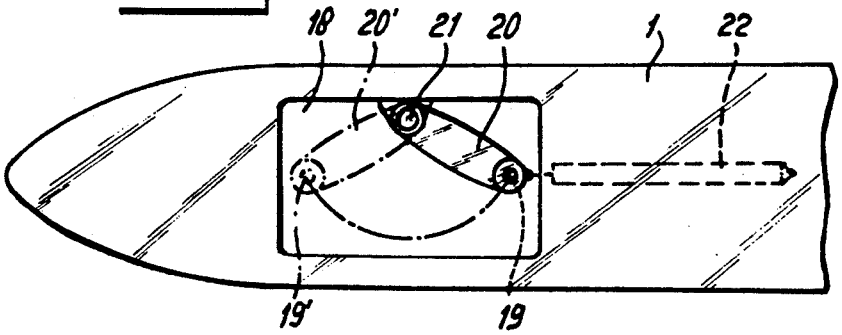

An alternative solution is obtained with the construction shown in FIGS. 6 and 7. According to said embodiment the vessel has a hollow space 18 within which a turntable 19 carrying the anchor lines is rotatably supported in a rigid arm 20 which has a vertical axis of rotation 21 at one side of said hollow space.

FIG. 7 shows the initial position in which the arm 20 is held by e.g. a hydraulic cylinder-piston unit 22. If the predetermined load is reached the resistance of the cylinder-piston unit 22 is overcome and the arm swings towards the position 20' indicated with interrupted lines. This means that the turntable 19 is moved into the position 19' allowing the load to follow the substantially horizontal part of the load-excursion curve of FIG. 10.

Figure 8:
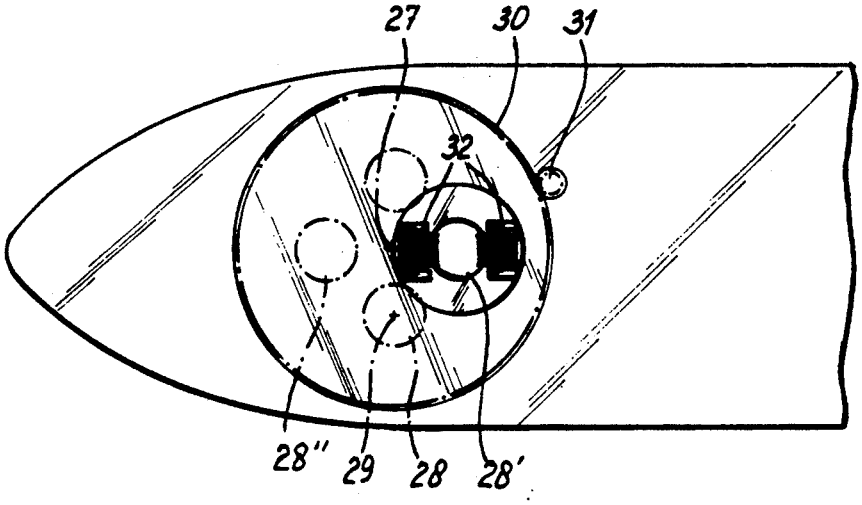
FIGS. 8 and 9 respectively relate to a third alternative.
Figure 9:
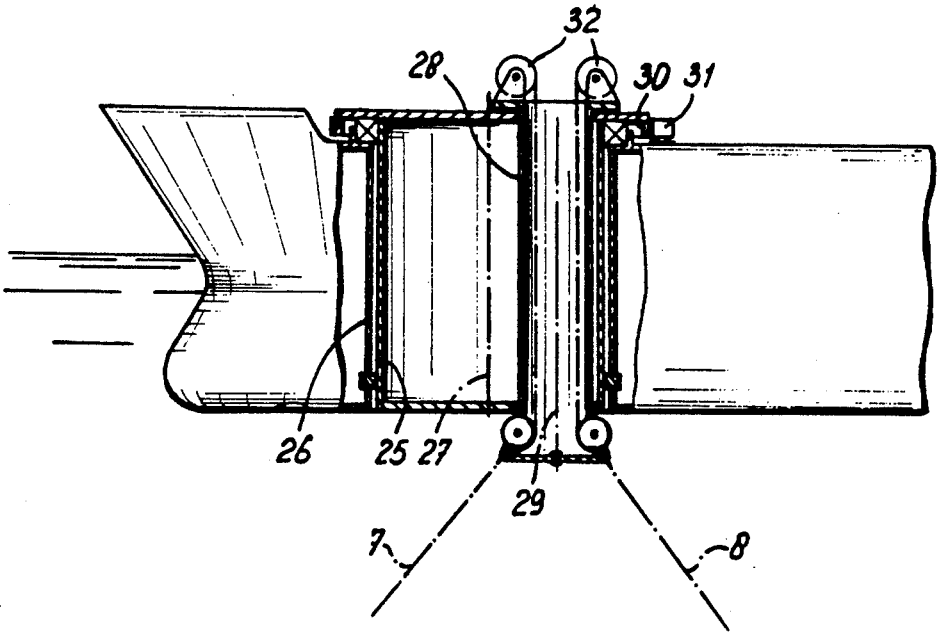

Another embodiment is shown in FIGS. 8 and 9 which in top and side view respectively show that the vessel, preferably adjacent to its bow, has been provided with a rotatable sleeve 25 inside a cylindrical space 26 in the hull of the vessel. Said sleeve has a central axis of rotation indicated with 27 and carries a rotatable body or turret 28 having its axis 29 at a distance from the axis 27.

Said sleeve may have a toothed edge 30 which is in engagement with a gear wheel 31 held in a fixed position by means of e.g. a hydraulic motor not shown. The hydraulic circuit of said motor can be such that it keeps the sleeve 25 in its position until a certain predetermined load is reached, however, it can be such as well that it can drive said sleeve from one position into another position.

The turret 28 has a top deck upon which winches 32 are placed to which are connected the anchor lines 7 and 8.

The initial position of the turret can be the most rearward position shown at 28' in which position the turret and accordingly the area of engagement of the anchor lines is in the central plane of the vessel.

In case heavy weather conditions are expected the turret can be moved with the gear transmission 31,30 into the position 28 in which the turret is laterally displaced with respect to the central vertical plane of symmetry of the vessel. In said position the loads on the anchor line will try to rotate the large sleeve 25 which movement is restrained by the hydraulic system acting through the gear transmission 30, 31.

Figure 10:
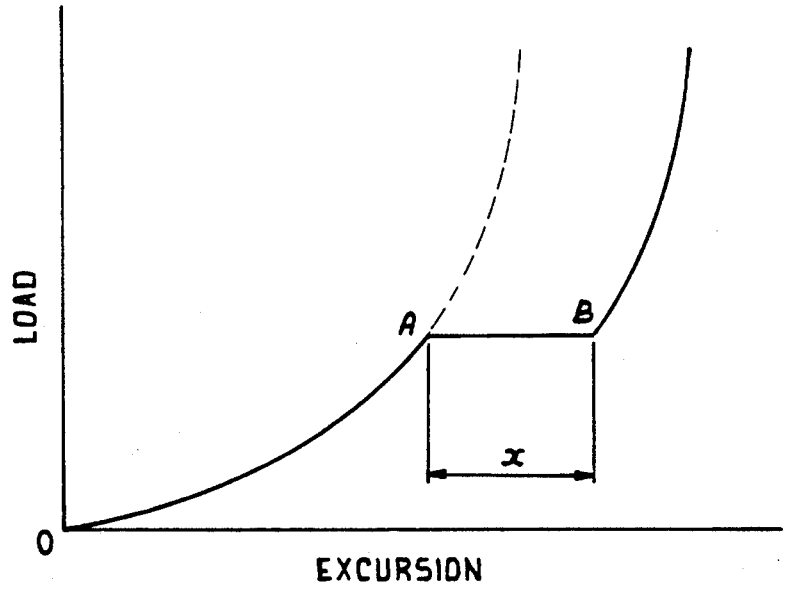
FIG. 10 is a load-excursion diagram obtainable with the invention.

However, if extremely heavy weather conditions occur and the predetermined load is exceeded the gear transmission can give way and the turret moves from the position 28 into the position 28'' allowing again the load to follow the substantially horizontal portion of the load-excursion curve shown in FIG. 10.

After return of normal weather conditions the gear transmission can be used for returning the sleeve 25 with turret 28 to its proper position.

In said last described embodiment the construction is most favourable with respect to the possibility of taking up occurring loads on bearings and on the hull of the vessel with the most favourable position of the turret and accordingly the place of engagement of the anchor lines.

I claim:

1. In a mooring device comprising an elongated vessel having a longitudinal axis, a body carrying anchor lines which extend in different directions according to catenary curves towards bottom anchors, said body being rotatably supported about a substantially vertical axis by a part which is movably connected with the vessel and held in an initial position with respect to the vessel by yieldable means which can give way to allow movement of the vessel away from the said body in the direction of said longitudinal axis in case the tension in at least one of the anchor lines exceeds a predetermined value and which thereafter urge said part toward said initial position; the improvement wherein the said movement of the body with respect to the vessel is guided by means which keep the vertical axis of rotation of the body vertical at all times, said part comprising at least one arm at a free end of which said body is mounted and which extends laterally at an angle with respect to said longitudinal axis of the vessel in said initial position of said part.

2. Mooring device as claimed in claim 1 wherein said at least one arm comprises an upper arm and a lower arm both rotatable about the same vertical axis.

3. Mooring device as claimed in claim 1, wherein said body is disposed off one longitudinal side of the vessel.

4. Mooring device as claimed in claim 3 wherein said at least one arm extends laterally from the bow of the hull with a length allowing swinging of said at least one arm towards the position in front of the bow with the body in front of the bow.

5. Mooring device as claimed in claim 1, wherein said at least one arm is present in a hollow space inside the hull and open at the bottom.

6. Mooring device as defined in claim 1, further comprising abutment means for limiting swinging movement of said at least one arm astern when said at least one arm is in a laterally extending position with respect to said longitudinal axis of the vessel.

* * * * *